US005599410A

United States Patent [19]

Reinders

[11] Patent Number: 5,599,410

[45] Date of Patent: Feb. 4, 1997

[54] METHOD OF AND DEVICE FOR MAKING LABELS

[75] Inventor: Peter Reinders, Ochtrup, Germany

[73] Assignee: Carl Schmale GmbH & Co. KG, Ochtrup, Germany

[21] Appl. No.: 211,599

[22] PCT Filed: Sep. 24, 1992

[86] PCT No.: PCT/DE92/00830

§ 371 Date: Apr. 6, 1994

§ 102(e) Date: Apr. 6, 1994

[87] PCT Pub. No.: WO93/07325

PCT Pub. Date: Apr. 15, 1993

[30] Foreign Application Priority Data

Oct. 9, 1991 [DE] Germany ..... 41 33 473.6

[51] Int. Cl.[6] ..... D05B 35/06; B32B 31/26

[52] U.S. Cl. ..... 156/64; 156/93; 156/227; 156/256; 156/308.2; 156/350; 156/361; 156/443; 156/510; 112/113

[58] Field of Search ..... 156/227, 495, 156/558, 569, 93, 204, 256, 350, 361, 64, 308.2, 510, 443; 112/113, 114; 271/42, 131

[56] References Cited

U.S. PATENT DOCUMENTS 4,548,141 10/1985 Freermann ..... 112/113
4,561,128 12/1985 Zimmerman ..... 156/93
4,986,864 1/1991 Heim et al. ..... 156/569
5,018,461 5/1991 Kato et al. ..... 112/104

FOREIGN PATENT DOCUMENTS 1228843 4/1971 United Kingdom .

*Primary Examiner*—Michele K. Yoder
*Attorney, Agent, or Firm*—Herbert Dubno; Andrew Wilford; Yuri Kateshov

[57] ABSTRACT

To implement a process for operating a device for making labels from strip material with a roll (1) of strip material, a feed device (2, 3) for the strip material, clamping tongs (16) to take the end of the strip from the feed device, a folding sheet (23) which inserts the strip between the jaws of positioning tongs (8) which transfer it to a processing device, and a separating device (7) to separate the strip from the strip material, by means of which strips of different lengths can be simply folded and processed, it is proposed that the movement cycles of the components of the device are controlled in such a way that, after the end of the strip has been transferred to the clamping device, first of all the folding device advances towards the positioning device, then the separating device (7) separates the strip from the strip material upstream of the feed device (2, 3) and either the positioning device closes and secures the folded strip while the folding device returns to the initial position, or after the strip has been separated the folding device advances until the strip is unfolded, when the positioning device closes and the folding device returns to the initial position.

8 Claims, 6 Drawing Sheets

METHOD OF AND DEVICE FOR MAKING LABELS

CROSS REFERENCE TO RELATED APPLICATIONS

This application is a national phase of PCT/DE92/00830 filed Sep. 24, 1992 and based, in turn, on German national application P41 22 473.6 filed Oct. 9, 1991 under the International Convention.

1. Field of the Invention

The invention relates to a method for operating a device for making labels, including looped labels, from strip material, consisting of a dispenser, particularly a rotatably supported roll with strip material or a stacker plate for folded strip material, a feeding device for the strip material wherein the strip end can be inserted and by means of which the inserted strip can be drawn off the dispenser, a gripping device, particularly a gripping clamp for receiving the strip end from the feeding device, a folding device or a folding plate which is transversely slidable with respect to the advance path of the strip and the feeding device and the strip between the jaws of a positioning device, which receive the inserted strip portion transferring it to a storage or processing device, whereby further a separating device for cutting off the strip from the strip material is provided, preferably between the feeding device and the gripping device.

The strip material can be arranged on a dispensing device in the form of a rotatably supported roll. But it is also possible that the strip material folded in zigzag be held in a corresponding stacking device and be removed quasi endlessly therefrom.

By means of the feeding device the strip material is drawn off the dispenser, preferably intermittently. The gripping device can be designed in different ways, but preferably as clamping tongs. The folding device can also be of any design, but consists preferably of a folding plate. "Transversely to the advance path" does not necessarily mean a right angle, but "transverse", can define a right-angle arrangement, as well as an oblique-angle arrangement or an orientation following of an arc of circle. The feeding device can feed the strip linearly, i.e. in a linear path. But it is also possible to make the feeding device so that it revolves around a fixed point of rotation, so that the advance of the strip material takes place along a circular-arc curve.

The separation device for cutting off the strip from the strip material can be arranged at a suitable place. Preferably it is arranged between the feeding device and the gripping device. However other arrangements are also possible.

2. Background of the Invention

An apparatus operating in accordance with the foregoing is described in DE 33 34 646 C2. With the known device it is possible to make U-shaped labels, as well as labels which are folded on top of each other or labels folded in a V-shape from strip segments and to transfer them to corresponding processing stations. The apparatus consists of a feeding device drawing off the strip from a strip roll, a controlled separating device for the strip as well as a subsequently arranged device by means of which the label can be transferred to a piece of fabric, so that the strip can be sewn to the edge (hem) of the piece of fabric in a sewing device.

When the strip is drawn off the roll, by means of a motor-driven or pneumatically movable feeding device, the strip is advanced by a prescribed stretch and is fed to tongs arranged in the path of advance of the strip. The feeding device has two flat rails, running parallel to each other, between which the strip can be inserted. In the rest position of the rails, there is a small distance left between them, so that the strip can be easily inserted. Immediately preceding the front end of the device, considered in the advance direction, a pair of rolls is arranged, which has the purpose to catch the rails as soon as they try to advance, after a short advance stretch and to press them against each other, so that the strip can not slide with respect to the rails. By means of this feeding device the strip is guided towards clamping tongs which grip the strip, whereafter the rails can be retracted. As soon as the rails have returned to their rest position, the strip is separated close to the rail end by the separating device. In a first embodiment of this device the strip hangs down vertically under the influence of gravity. By means of a folding device the strip is then folded. The folding device consists mainly of a folding plate which is arranged in a guide, slidable in longitudinal direction. As a servo-drive for the advance and return motions, a pneumatic working cylinder can be provided. The folding plate has a folding edge running transversely with respect to the displacement of the folding plate, as well as laterally connecting therewith, two obliquely converging folding edges. Frontally in the advance direction of the folding plate, at a distance from the path of the yet unfolded strip segment, an auxiliary support frame serving as a guide is provided, through which the folding plate can reach. The entire device is compacted into a unit and fastened to the margin of a conveyor table or similar machine stand.

The cutoff strip still hangs in the gripping tongs vertically outwards under the influence of gravity. When the folding plate is then moved in the direction of the strip, it guides the strip which it entrains in the middle into the slot of the support frame. At the same time the clamping tongs open, so that the strip segment is freely foldable. Subsequently the strip segment is transferred to a positioning device, by means of which the strip can then be sewn to the border of a textile web. In this design it is possible to provide the strip either with wings folded on top of each other or to fold the strip into a V-shape by inclining the slide bar. In a further embodiment according to the state of the art it is possible to fold the strip to a U-shape by means of the folding plate, whereby the cooperation of the folding plate with a folding plate of the same shape is required. Thereby the folding plate is swingable and longitudinally slidable. The strip feeding takes place in the plane of the sliding motion of the folding plate, and not transversely to this plane, as is the case in the aforedescribed embodiment.

Inasmuch as strips of various lengths have to be made in this known device, considerable adjustments have to be made, because it is necessary to change not only the adjusting path of the strip feeding device, but also the arrangement of the clamping tongs, so that each strip can again be positioned in the middle with respect to the folding plate. As a result not only is the manipulation cumbersome, but complex means have to be provided for such an adjustment.

OBJECT OF THE INVENTION

It is the object of the invention to provide a method and an apparatus for making labels, by means of which with little constructive effort such an adjustment can be made quickly and simply, so that strips of various lengths can be folded and processed.

SUMMARY OF THE INVENTION

In order to achieve this object the invention controls the motion sequences of the device parts in such a way that, after the transfer of the strip end to the gripping device and preferably after the feeding device is retracted, or when the feeding device is in advance position between the former and the separating device, first the folding device advances in the direction of the positioning device, then the separating device cuts off the strip material in front of the feeding device and either—preferably almost simultaneously—the positioning device closes and fixes the strip while the folding device returns to its initial position, or after the separation of the strip the folding device advances until the strip is unfolded, then the positioning device closes and the folding device returns to its initial position, or before the separation of the strip from the strip material, the strip material is kept firmly in place in the area of the feeding device end facing the gripping device by means of a second gripping device or the feeding device itself, the first gripping device releases the strip end, the folding device advances until the strip material unfolds, then the positioning device closes, the folding device returns to its initial position and the strip is cut off in the area of the second gripping device or upstream or downstream thereof.

In this kind of operation the strip end is kept securely in place in the gripping device, preferably clamping tongs, and not yet separated from the strip material coming from the strip roll. Depending on the design of the feeding device either the feeding device is retracted and after the withdrawal of the feeding device for the strip, first the folding plate can advance towards the positioning device, particularly the positioning tong, whereby a certain advance is selected corresponding to the wing length of the strip to be produced, or in the case of an unfolded label, corresponding to the length of the strip. However it is also possible to leave the feeding device in its most advanced position, in which it introduces the strip material into the gripping device. The separating device can then intervene directly between the feeding device in its most advanced position and the gripping device and cut off the strip material. It is also possible to provide the feeding device with a throughgoing slot or the like, through which the separating device can reach, so that in the most advanced position of the feeding device the separating device can reach through the feeding device and cut the strip. In this way the motion sequence is reduced by one process step.

It is thus possible for the user to produce strips with various wing lengths, within the range of the possible adjusting path of the folding device (folding plate). Every strip has wings of the same length, but the length of the wings is variable, depending on the advance path of the feeding device. In the case of strips which are folded one on top of the other, the strip is inserted in the positioning device (tongs) by means of the folding device (folding plate). The positioning tongs can close and at the same time the strip material can be cut directly ahead of the feeding device by means of an appropriate separating device. The synchronization of these motions is not a requirement, but is advantageous. By means of the positioning device the folded strip can be transferred to a processing station, for instance a sewing station, or the strip can be deposited in a magazine. Provided that the strip is not folded, but an unfolded strip is desired, alternative methods of operation are possible. On the one hand it is possible that after the separation of the strip the feeding device advances to the point where the strip is completely unfolded. Thereby the first clamping tongs still hold the first strip end. Only after the strip is completely unfolded, will the positioning tongs close and secure the unfolded strip end, while the folding plate resumes its initial position and the clamping tongs release the strip.

By means of the positioning tongs the unfolded strip can then be transferred for further processing or deposited in a magazine. As an alternative it is also possible to first introduce the strip in the gripping device (clamping tongs) by means of the feeding device and then to close the gripping device. After that the folding device can advance and fold the strip to a loop.

Subsequently the strip to be worked on which is still attached in one piece to the strip material in the area of the feeding device can be held in place by the feeding device itself or by a second gripping device, while the first gripping device releases the strip end. Subsequently the folding device can advance further towards the positioning tongs, whereby an advance corresponding to the length of the unfolded strip is selected. When the strip is completely unfolded and introduced in the positioning tongs, the positioning tongs are closed and the strip can be cut off by an appropriate cutting device immediately in front of the feeding device. It is also possible to arrange the cutting device in the area of the feeding device, for instance so that it reaches through the feeding device in order to make the cutting of the strip possible. Finally it is also possible to arrange the cutting device in front of the feeding device, seen in the feeding direction of the strip, and to perform the strip separation right there. Essential for the process is only that the strip to be formed be securely held at a subsequent end, either the end which is anyway free or at the end which is freed later by separation and that the folding device is then actuated to run forward to the extent where the strip is fully unfolded and the positioning tongs is engaged with one end. By separating the strip from the strip material, the strip can be then moved further by the positioning tongs.

Due to the method of the invention the adjustment of the device for the purpose of changing the strip length is very much simplified, so that the means for producing strip of various lengths is also simple.

A preferred further development consists in that after the insertion of the strip material in the feeding device before the advance motion starts, the strip material is kept in place close to the front end of the feeding device considered in travel direction by pressure rollers, particularly in that the pressure rollers are advanced together with the feeding device and that the strip material is released by the pressure rollers only after the strip end was transferred to the clamping tongs and the feeding device was retracted.

This arrangement insures that the strip existing in the feeding device is unslidably held and forcibly entrained, whereby the pressure rollers, contrary to the teaching of the state of the art, are first moved into the engagement position and only then does the feeding device start to operate.

In a further preferred embodiment the folding plate during its displacement towards the positioning tongs is braked before the selected target length for the label (strip segment) to be made from strip material is reached, subsequently or at the same time a print mark reader is activated by means of which the print mark of the strip segment to be produced is detected and that after the print mark is detected the strip segment is separated from the strip material in the area of the print mark.

Usually during the process the folding plate is moved towards the positioning tongs with considerable speed, so that it is very difficult to subject it to scanning by a print mark scanner and it is also very difficult to section it with a cutting device without any problems. In order to simplify the motion sequence and to perform an accurate scanning by a print mark reader, as well as an accurate sectioning by the cutting device, the embodiment is preferred because during the braked motion the scanning by the print mark reader is facilitated and in addition the latter starts to function when triggered by the arresting motion, so that preceding components of the strip, such as imprints or the like do not lead to false interpretations by the scanner. By slowing down the motion it is also much simpler to cut off the strip segment at the desired point.

In order to insure that the folded strip does not lose its shape even after its transfer to the positioning tongs and optionally also after the transfer to the further processing station or a magazine, the wing ends of the folded strip segment are connected to each other after their separation from the strip material, preferably hot-sealed to each other.

In a preferred method for producing U-shaped labels, the wings of the strip are pushed around the converging edges of a shaping plate, so that a U-shape is formed, namely by means of a folding plate with an approximate U-shape, which is moved linearly from a position above the strip and parallel with respect to the strip and the shaping plate into a position below the shaping plate. After this the shaping plate is moved in the direction of the positioning tongs and the latter is moved in a straight line, preferably in the direction of the shaping plate, so that the strip is taken over by the positioning tongs before the wings exit fully from the slot between the shaping plate and the folding plate.

In this embodiment over a separate supply mechanism a corresponding strip is supplied, whereby the folding of the strip is performed solely by the folding plate, which is advanced linearly and transversely with respect to the surface extent of the shaping plate. Subsequently the shaping plate is moved across the displacement path of the folding plate and in this way the strip is delivered to the positioning tongs.

To simplify adjustment of the feeding device to various strip widths, the feeding device is provided with a guide channel for the strip material. The guide channel has lateral walls which can be moved in parallel towards each other or away from each other and secured in position, for the purpose of adjusting to the different strip width.

In order to entrain the strip which is in the feeding device in a well defined manner, pressure rollers secured to the frame can be provided close to the opening of the feeding device, by means of which the walling areas of the feeding device oriented parallel with respect to the strip plane can be pressed against each other.

In order to enable the print mark reader to be as small and as compact as possible, so that it can be arranged in the desired areas in a simple way, it is proposed the print mark reader can be provided with a reading head with light guide cable.

Further heat-sealing tongs for heat-sealing the strip ends are preferably provided between the separating device and the positioning tongs.

A preferred variant can be considered the arrangement of the folding plate in such a way that it is adjustably guided by mechanical means on a device component (e.g. a sliding carriage) guided on the frame side and that the drive of the folding plate is a stepping motor, or that when driven by means of a working cylinder actuated by pressure media the travel path is limited by an adjustable positioning stop.

A switch can be coupled with the advance device for the folding plate, by means of which the print mark scanner is switched on when a certain position is reached in the advance direction.

Preferably the advance speed of the feeding device is forcibly braked before the cutting position is reached, whereby particularly a brake cylinder with throttle arranged as a braking element is mounted on the advance device and moves together with it and is movable against a stop rigidly mounted to the frame before the target position is reached.

Finally it is advantageously provided that between the strip roll and the feeding device a sensor be arranged, by means of which the presence of the strip material can be detected and which is coupled with a control mechanism, which can interrupt the operation of the device or installation.

BRIEF DESCRIPTION OF THE DRAWING

The above and other objects, features and advantages will become more readily apparent from the following description, reference being made to the accompanying drawing in which.

Figure 1:
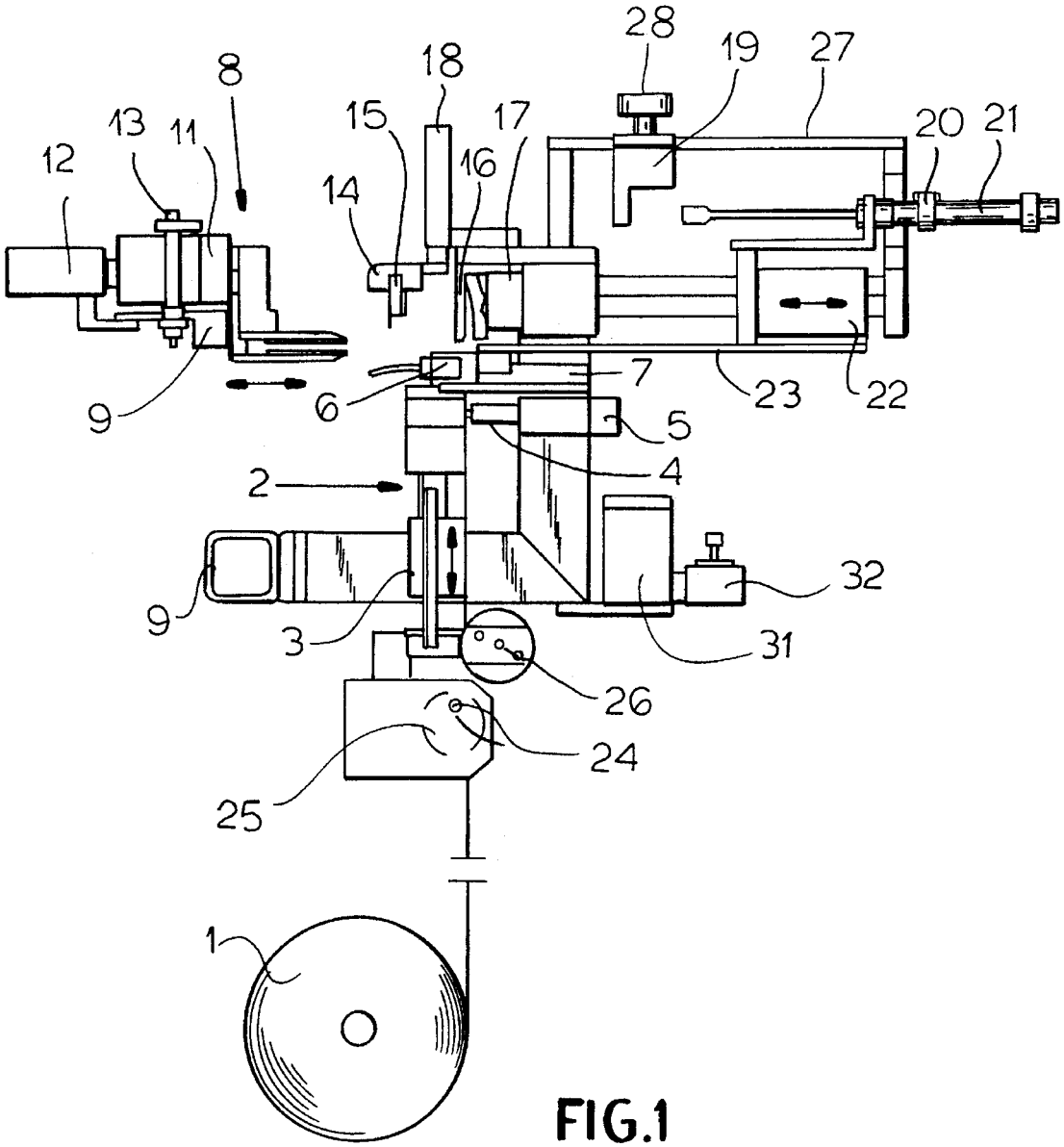
FIG. 1 is a side view.

A strip roll 1 with strip material is rotatable about an axis rigidly mounted on the frame. The width of the strip material can be for instance 10 to 50 mm, whereby any intermediate size can be processed. The length of the individual labels can be, for instance, 60 to 130 mm in the folded state, and approximately 30 to 65 mm in the unfolded format. Here too any length within these ranges can be processed. In order to keep the correct length sequence, on the material at certain intervals there has to be a print mark approximately 10 mm wide and 1 to 3 mm long.

The device 2 provides for the adjustment of the guide part of the entire device to the width of strip 1. This design offers a device which makes it possible for the operator to set another label width without fuss and waste of time. The setting device consists of a spindle with left-hand/right-hand thread, which is driven by a handwheel. When the spindle is actuated, two guide blocks are moved in parallel serving for the lateral fixing of the label.

The linear feeding device 3 is moved upwards, or downwards by in the direction of FIG. 1 by means of a pressure-media actuated cylinder, in order to transport the labels, or the strip, to the clamping tongs 16. The pressure rollers are marked 4. The linearly displaceable feeding device 3 is located between the pressure rollers 4. The rollers are arranged on both sides of the displacement path, whereby the one roller 4 can be moved towards the other roller 4 and be moved away from it by means of a pressure-media actuated cylinder. When the rollers are moved towards each other, the feeding device including the inserted strip can move together, without changes in the position of the moving strip. After reaching the target position and transfer to the clamping tongs 16, the adjustable roller is moved away from the other roller, so that the strip material can move between the elements of the feeding device and can be taken off roller 1.

A short-stroke cylinder 5 serves for releasing and clamping the pressure roller 4 located to the right in FIG. 1.

In the state of the art a print mark reading head is screwed directly on the automatic label machine. Due to the size of the print mark reader,in this arrangement it is not possible to directly scan the label supposed to be cut off, but only every second label can be scanned. As a result whenever the length is changed, the reading head has also to be adjusted correspondingly. This is very cumbersome and has to be done in a highly accurate manner in order to insure a precise repeat pattern of the length to be cut. This arrangement translates into a relatively large structure.

In the invention a reading head with a light guide cable is integrated in the print mark reader, which due to its small size makes possible the direct scanning of the label to be cut. Since the scanner head is height-adjustable the cutting position can be set individually.

The numeral 7 represents a cutting device shaped like a scissors, with an upper blade and a lower blade.

The numeral 8 indicates positioning tongs which take over the label after its length has been set by means of the folding plate 23 and transfers the label by means of a servo-drive to a succeeding element, for instance the hem of a towel onto which the label is to be sewn.

A pressure-media actuated parallel cylinder 11 causes the gripping motion of the positioning tongs 8. The numeral 12 is a pressure-media actuated short-stroke cylinder with a linear drive unit, by enables the positioning tongs 8 to be moved linearly from the transfer position to the delivery position on a piece of cloth or to a magazine.

Figure 2:
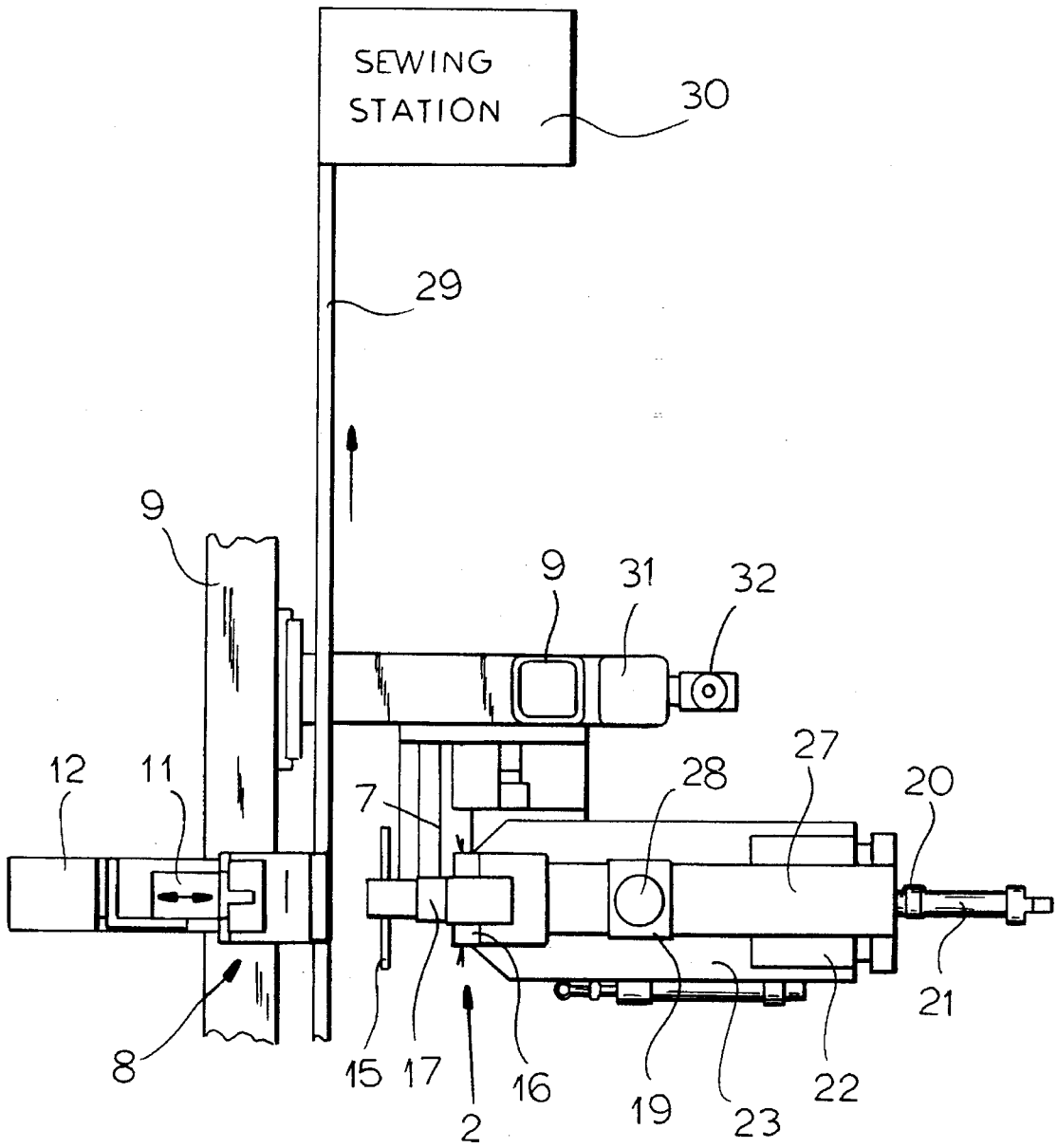
FIG. 2 is a top view.
Figure 3:
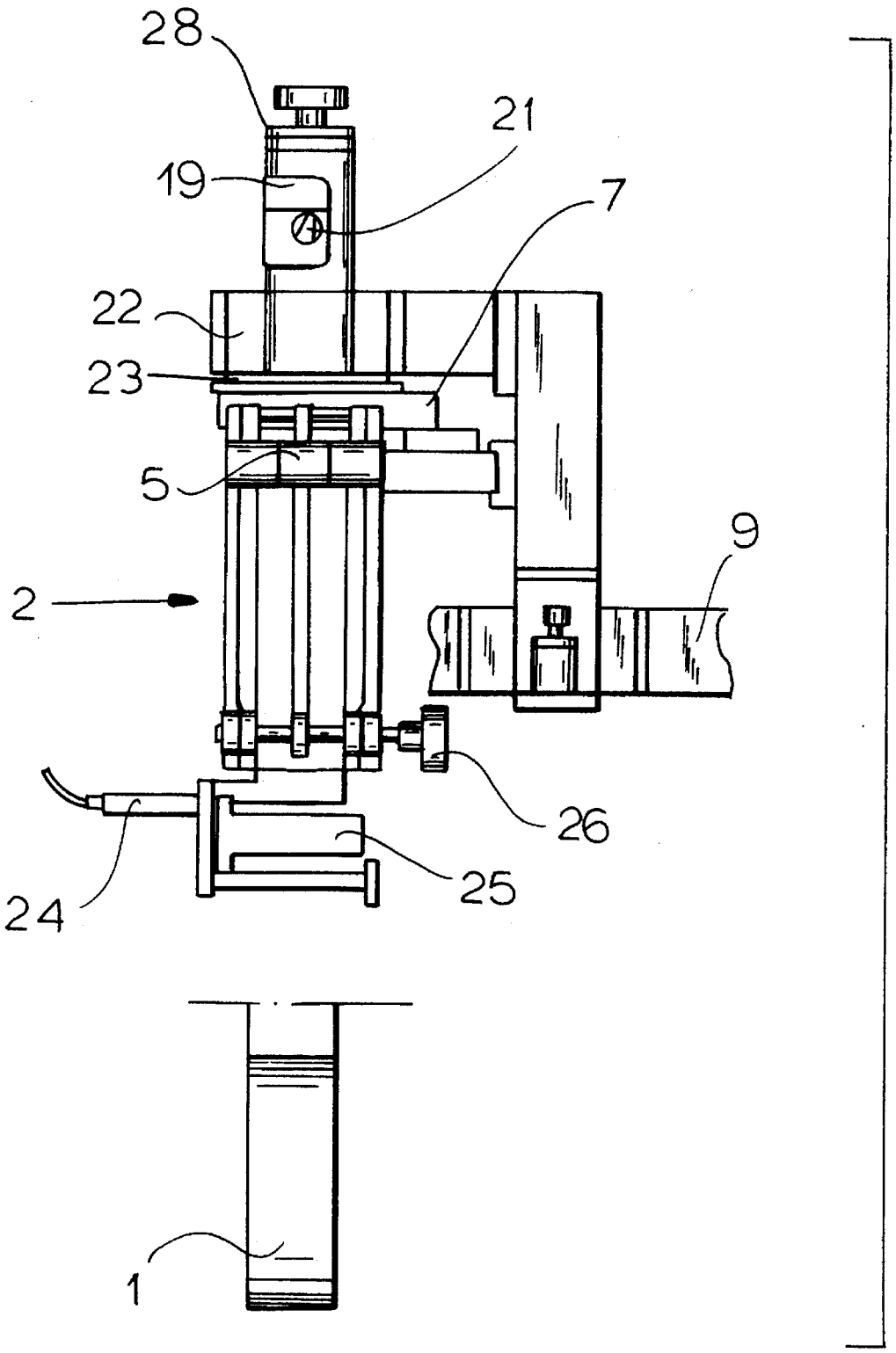
FIG. 3 is a view rotated with respect to FIG. 1 of a schematically illustrated device for folding labels with wings folded on top of each other or in an unfolded state.

For instance in order to insert a correspondingly folded label into a hem, the positioning tongs 8 can be displaced along the hem, which as can be seen especially in FIG. 2 lies on a conveyor belt by means of which the hem is transported towards a sewing station 30. Thereby a guidance function is accomplished by the guiding element 13.

A lever 14 is acted by a pressure-media actuated cylinder (short-stroke cylinder 18). In this way a lifting motion of heat-sealing tongs 15 is achieved. The heat-sealing tongs 15 [serves] for preventing the label wings from sliding during their transport to a subsequent processing station, for instance to a hemming device and to a sewing station 30. For this purpose the end pieces of the labels folded on top of each other are sealed together. Preferably a hot sealing wire is provided for this purpose, which has a jagged tip and is heated by a transformer and which is pressed for a short moment on the label pieces. Then the labels are fixed in position by melting the material. In order to be able to cut to length the strip material to be processed with the assistance of the folding plate 23, it has to be arranged in the area between the clamping tongs 16 and the cutting device 7. The feeding device 3 transfers the strip material to the clamping tongs 16 which grip the corresponding strip end. Then the feeding device is retracted and by advancing the folding plate 23 the length of material to be cut is set, whereby additionally it is drawn off the roller 1.

By means of a short-stroke cylinder a movable gripping device consisting of clamping tongs 16 can be actuated.

The numeral 19 marks a positioning stop. The length of a corresponding label is determined by the length of the displacement path of folding plate 23. This displacement path is limited by the position limit stop 19. This position limit stop 19 can be adjusted, for instance by means of a threaded spindle. There is another adjustment possibility by simply clamping it to a graded support 27 by means of a thumb screw 28. The scale support 27 is parallel to the adjusting direction of the folding plate 23. The limit stop 19 can be arranged at any place in the respective adjustment path.

As a substitute solution for the arrangement of such a position limit stop it is also possible to perform the linear adjustment of the folding plate 23 by means of a stepping motor. Thereby corresponding position switches or corresponding control for the stepping motor can be provided as a substitute for the position limit stop.

Usually on the strip material in the area where later a label will be formed an advertisement text or the like is placed, which basically has the same color as the print marks made for the location of the cuts. In order to prevent the print mark reader 6 from confusing the advertisement text with the cutting border, the scanner head of the print mark reader 6 is switched on only about 10 mm before the actual print mark appears. This is achieved by providing a Cetop cylinder 21 which moves together with the folding plate 23. Its piston rod hits against the position limit stop 19. This way the piston is pushed into the cylinder, whereby a magnet switch is actuated, which releases the print mark reader 6 to perform its desired function.

Here too by providing a stepping motor it is possible to release the print mark reader after a certain number of steps.

The setting of the label length by advancing the folding plate 23 takes place at high speed. In order to insure a precise separation at the print mark, the folding plate 23 has to be braked shortly before reaching the cutting position. The cylinder 21 takes over the braking function, whereby the braking force can be set over a throttle 32. The cylinder is driven with oil from an oil tank 31.

With a stepping motor it is possible after a certain number of steps to automatically slowdown the process speed and thereby the movement of folding plate 23.

The numeral 22 marks a linear drive with a pressure-media actuated working cylinder. By means of this drive unit 22 the folding plate 23 is driven in the direction of advance and return. When a stepping motor is used, merely a corresponding part performing only guidance tasks would have to be provided.

The folding plate 23 takes over the length setting and the folding of the strip material to be processed. A radius mounted at the free end of the folding plate facilitates the sliding of the label and prevents damage to the weft threads in case of woven labels.

In the area between the strip roll 1 and the feeding device 3 there is a surveillance device for detecting whether the strip material is fed or not. For this purpose the strip material is guided past a control wheel 25 which is set in rotary motion by the strip. On the control wheel 25 metal plates are fastened, which run past a proximity switch 24. The impulses emitted by the proximity switch 24 are evaluated by a SPS (stored-program system) control and when failure is indicated the drives of the device are stopped.

The numeral 26 marks a spindle by means of which the mutually parallel guide edges of the device can be adjusted for setting the width of the strip.

The numeral 27 marks the scale support on which the position limit stop 19 can be adjusted by means of a clamping device 28. The scale support has a graduated scaling which can be read optically. When the drive is replaced by a stepping motor construction the corresponding adjusting path can be read on the control of the stepping motor.

Subsequently the process sequence in the case of folded labels is described.

First the strip material to be processed is introduced from the strip roll 1 passing under the control wheel 25 into the feeding device 3 with the width-adjustable guide channel. With the pressure roller 4 displaced to the right according to FIG. 1, the material can be moved until it exits the opening of the feeding device and is placed in the area of scissors 7.

The strip material gripped between the right pressure roller 4 later to move to the left, the guide channel (part 2) and the pressure roller 4 on the left, is transported by the linear feeding device 3 into the clamping tongs 16. The latter is then closed by actuating the short-stroke cylinder 17. As soon as the clamping tongs 16 have taken over the strip material, the pressure rollers 4 are released, so that the entire feeding device, including the width adjustable channel, is brought back to its initial position. After reaching the extreme position the linear drive unit 22 is driven pneumatically or electrically, for instance with a stepping motor, thereby setting the folding plate 23 into motion, namely in FIG. 1 from right to left. Since the strip material to be processed is held in the gripping tongs 16, the additionally needed strip material corresponding to the advance of the folding plate 23 has to be pulled through the now released pressure rollers 4, the width-adjustable channel and the control wheel 25. Provided that no longitudinal transport takes place because the strip material 1 is totally unwound from the roll, the control wheel will emit a failure signal caused by a lack of impulses and the entire device will be stopped.

While the length is set by advancing the folding plate 23, the piston rod of cylinder 21 hits the position limit stop 19 set correspondingly to the repeat pattern of label length. As a result a braking takes place. At a further movement of the folding plate 23 the magnet switch 20 is activated, thereby controlling, e.g. enabling, the print mark reader. As soon as the print mark of the strip has reached the scanner head due to the further advance of the of the folding plate 23, the scissors 7 receive the cutting pulse. At the same time the positioning tongs 8 into which the folding plate 23 has moved together with the strip closes. The positioning tongs take over the ready folded label, while the folding plate 23 is moved back into its initial position by means of the linear drive 22. Then the heat-sealing tongs 15 shown in FIG. 1 moves downwards for a short moment and fixes the label wings to each other.

Over the short-stroke cylinder with linear servo unit 12 the label is now for instance positioned with respect to the hem which lies on the conveyor belt 29, by means of which it is transported to the sewing station 30. The label is first correctly positioned with respect to the hem and then is moved via guide 13 at the same speed as the conveyor belt 29 and then inserted into the hem. In the sewing station 30 the label is then sewn together with the hem. After the label has been inserted in the hem, the positioning tongs 8 withdraw to their initial position and the work sequence can start again.

The corresponding process sequence in the case of unfolded labels is as follows.

The strip material drawn off the strip roll 1 passes under the control wheel 25 and is inserted in the channel of the feeding device 3 and pushed through, namely until it reaches the area of scissors 7. By adjusting the pressure roller 4 the strip material is securely held with respect to the feeding device, so that it can be Pushed forward together with it. Then it is received by the clamping 16 which are closed by actuating the short-stroke cylinder 17. After the gripping tongs 16 have taken over the material, the pressure rollers 4 are released and the feeding device 2, 3 can return to its initial position. When the extreme position is reached the linear servo unit 22 is pneumatically or electrically actuated, for instance by a stepping motor, thereby setting the folding plate 23 into motion. Since the material to be processed is held in the gripping tongs 16, the additionally needed material has to be pulled through the now released pressure rollers, the guide channel and the control wheel. If there is no transport in longitudinal direction, the control wheel will give a failure signal, based on the lack of impulse, which will lead to the stoppage of the machine.

During the advance of the folding plate 23 the piston rod of cylinder 21 is braked when it hits the position limit stop 19, which previously has been correspondingly adjusted to the repeat pattern of label length. At a further advance the magnet switch 20 is activated and the print mark reader is released.

In the position wherein the print mark has reached the scanner head of the print mark reader due to the further advance of the folding plate 23, the scissors 7 receive the signal for cutting.

After the scissors 7 have been returned to their initial position, a sliding motion of the folding plate 23 follows, whereby the label previously folded in the positioning tongs 8 is straightened out. At the same time the positioning tongs 8 can be moved parallelly and in the same direction with the folding plate 23. As soon as the folded label is straightened out, the tongs 8 close and the label can be laid out like a flag on a piece of cloth in the hem area or can be deposited in a magazine.

Figure 4:
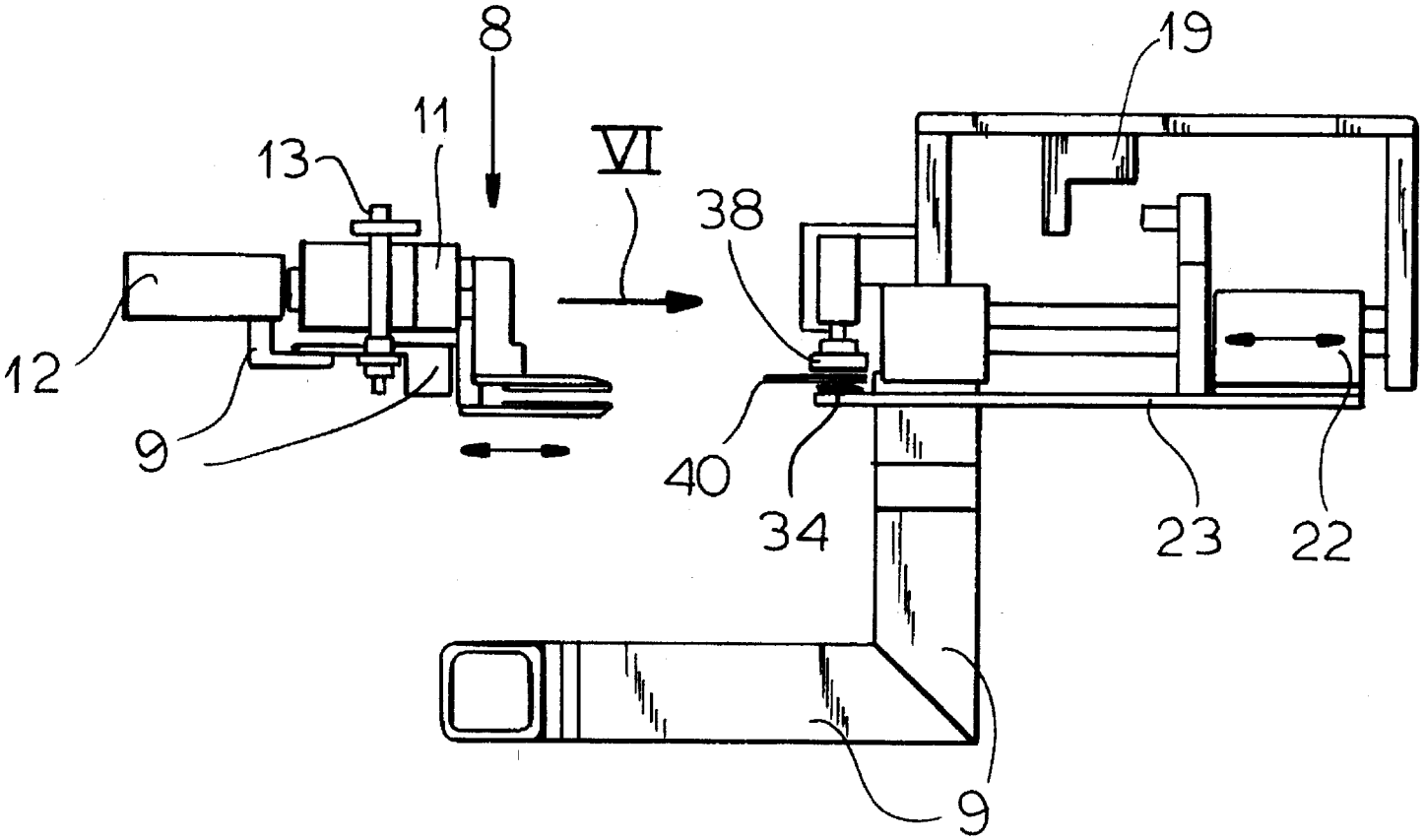
FIG. 4 is a side view of shows an embodiment for folding U-shaped strips in a lateral view.
Figure 5:
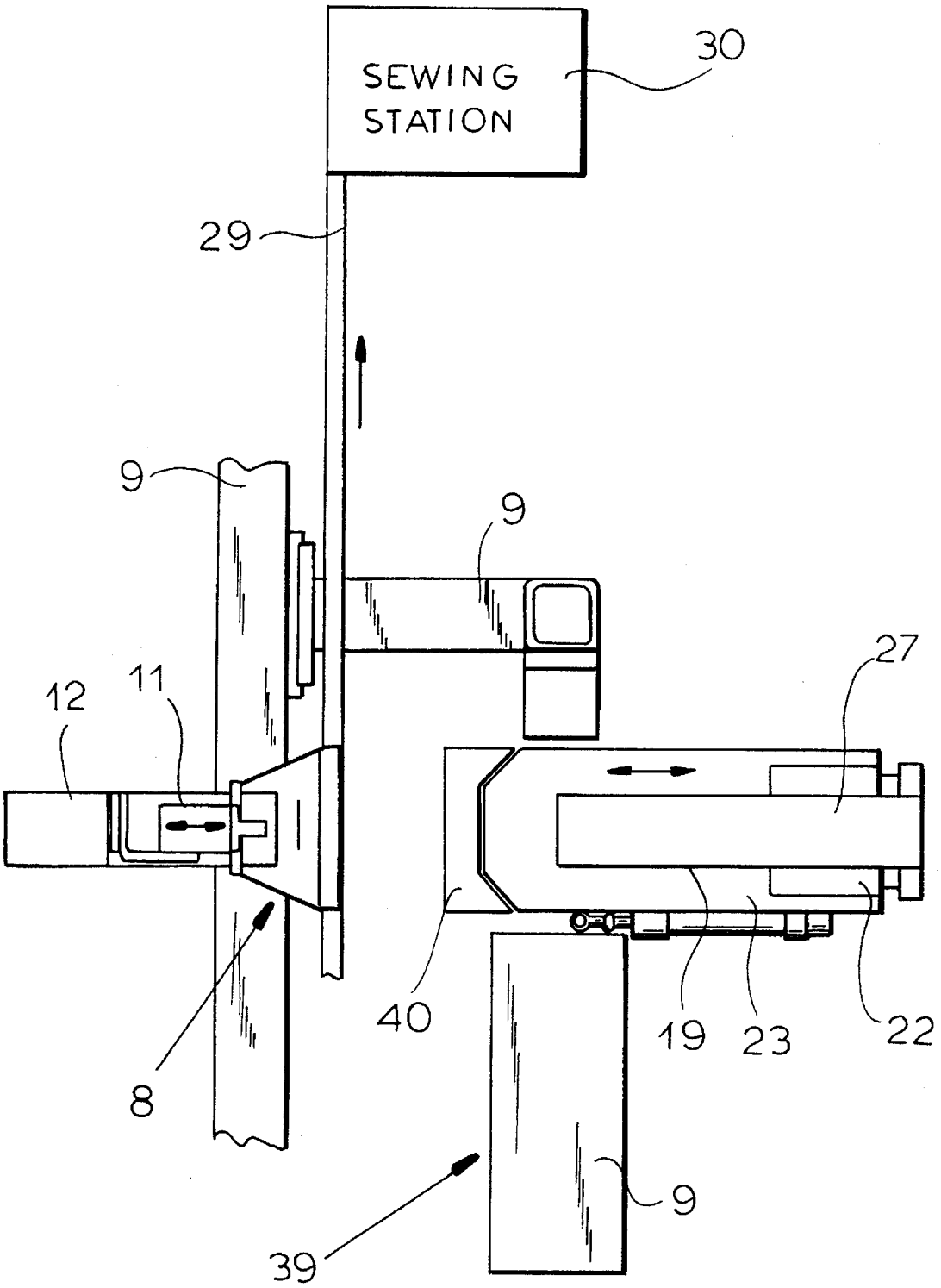
FIG. 5 a top view of the latter.
Figure 6:
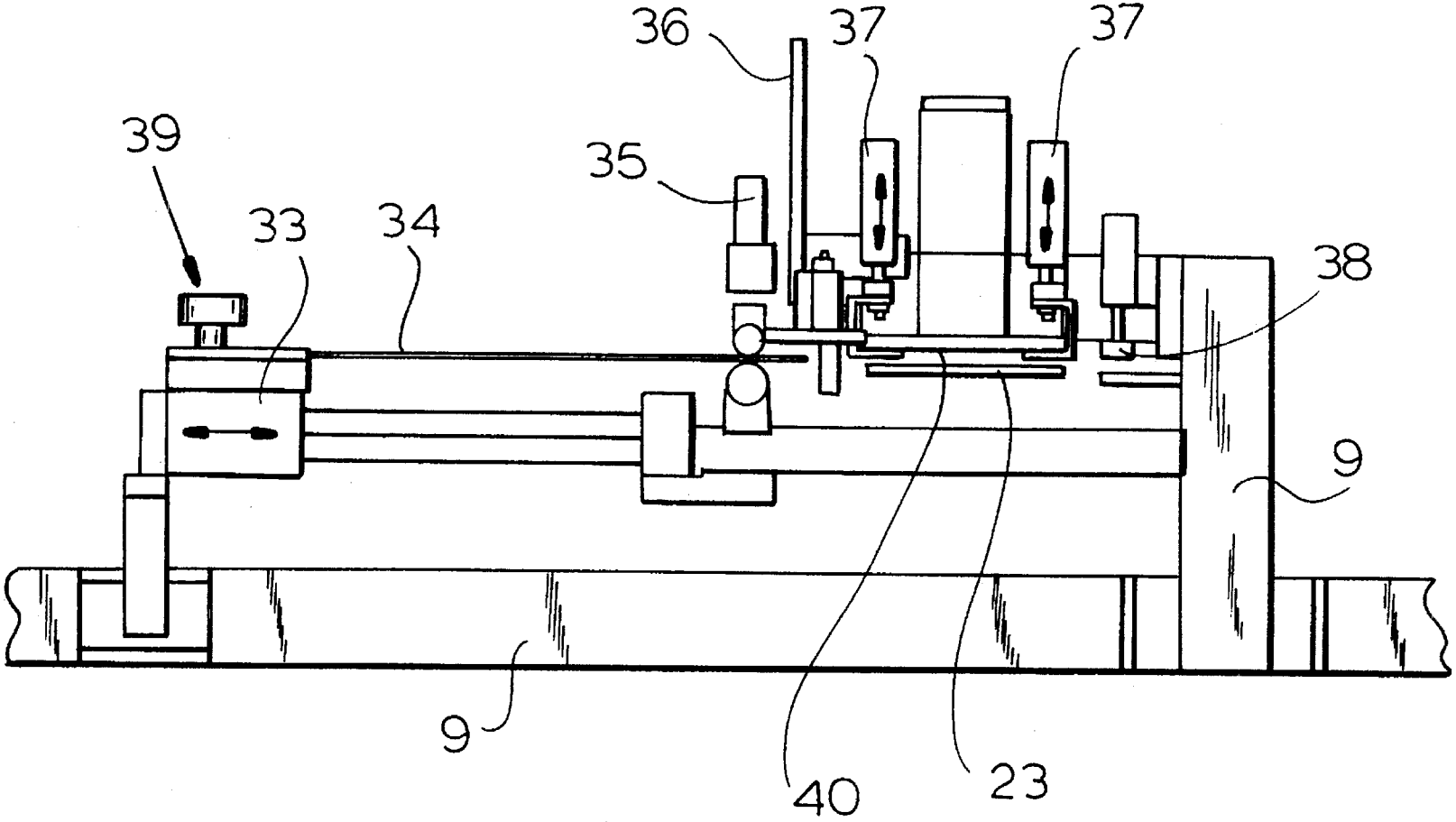
FIG. 6 is and end a frontal view of the device according to FIG. 4 seen in the direction of arrow VI of FIG. 4.

In order to deposit the label on the seam it is brought by a short-stroke cylinder with linear unit 12 in position with respect to the seam from where over guide 13 and with the same speed as the conveyor belt 29 it is inserted for instance in a hem. From there it is transported to the sewing station 30 and for instance sewn together with a hem. After it is inserted, the positioning tongs 8 returns to its initial position and the work sequence can start again. In FIGS. 4 to 6 a further functional development is shown. This construction serves for the additional processing of U-shaped labels and is meant to be mounted on the machine frame as an addition to the aforedescribed device. It has to be noted that the machine frame is marked with the numeral 9 in all embodiments. In this additional embodiment a sliding carriage 33 with an adjustment mechanism 39 for the width of strip and a guide 34 are provided. They are mounted on the machine frame 9. The strip material to be processed is located between two guide rails or guide plates 34. It is delivered to tongs 38 (clamping tongs) by applying the pressure of an adjustable pressure roller 35 against a counter roller. The sliding carriage moves at first from left to right in FIG. 6., until the strip is transferred to the clamping tongs 38. After that the sliding carriage with the pertaining guide elements retracts. Subsequently the strip material is cut by scissors 36. After that the clamping tongs 38 are opened and by means of servo elements, in the embodiment example cylinder 37, a U-shaped folding plate 40 is brought down from a position above the strip segment in FIG. 6, so that it lies below the plane of the strip segment. The strip segment lies in the median area of the forming plate 23 which supports the strip segment with established length. As a result of this movement of the folding plate 40 in relation to the forming plate 23, the wings of the strip are folded over so that a U-shaped strip results. The in a manner known per se the folding edges are converging edges of the folding plate and the forming plate. In the construction of the invention the folding plate 40 is merely moved down in a straight line according to FIG. 6. The converging oblique lines of the folding plate and the forming plate are inclined at an angle of 45°. In a next step the forming plate 23 advances, while the positioning tongs 8 is displaced in the direction of the front edge of the forming plate, i.e. to the right according to FIG. 4. The forming plate 23 pushes the label into the open positioning tongs 8, whereby the wings of the strip are located between the forming plate 23 and the folding plate 40 until the frontal area of the strip is in the positioning tongs. After the final position is reached, the positioning tongs 8 is closed and the folded label is taken over, whereby at the same time the forming plate 23 retracts and the positioning tongs 8 moves to the left according to FIG. 4. Via the short-stroke cylinder with linear servo drive 12 the label is brought by the positioning tongs 8 in the correct position with respect to the hem of the cloth piece which lies on the conveyor belt 29. It is moved at the same speed with the conveyor belt 29 and inserted in the hem. From there it is conveyed to the sewing station 30 and for instance sewn into a seam. After the insertion the positioning tongs 8 withdraw to their initial position and the process sequence can start from the beginning. The drive for the displacement of the forming plate 23, as well as especially the drive for the feeding device 39 can be effectuated by a stepping motor.

It is also possible to deposit the shaped label in a magazine. For this purpose the work sequence is the same as in the insertion of the label into the hem, up to the point when the label is taken over by the positioning tongs 8 or by a transport device working in the same way.

After the label has been taken over, for instance by the positioning tongs 8, the label can be fused with the hot-sealing tongs 15, or can also be pressed against a heated plate or the like, in order to give the label a permanent shape. It is also possible to have both procedures on one label.

After the above-described fixation process is accomplished, the label can be delivered to a stacking device or to a container. The work sequence can then start all over again. The container for depositing the labels can for instance be a label magazine or the like.

I claim:

1. A method of making labels, comprising the steps of:

(a) feeding from a supply of strip material, a length of said strip material upwardly across a path of a horizontally shiftable folding plate;

(b) pressing a pair of pressure rollers against said strip material close to an upper end thereof, engaging thereby said strip between said pressure rollers advancing upwardly simultaneously with said material strip;

(c) engaging an upper end of said length of said strip material in a gripper at a location above said path whereby said length of said strip material is spanned across said path;

(d) thereafter pulling apart said pressure rollers, thereby releasing said material strip;

(e) thereafter displacing said plate in one direction along said path to deflect said length of said strip material in said direction along said path and said plate between jaws of a pair of positioning tongs open toward said plate;

(f) severing said length from said supply below said plate and only after said plate has deflected said length between said jaws;

(g) retracting said plate in an opposite direction along said path leaving a portion of the deflected length of said strip material between said jaws;

(i) closing said jaws to engage said portion in said positioning tongs; and (j) releasing said upper end by opening said gripper.

2. The method defined in claim 1 wherein said step (d) further comprising the step of retracting said rollers downwardly and pressing them against said feeding means during severing of said length in step (f).

3. The method defined in claim 1, further comprising the step of stopping displacement of said plate in said one direction in response to reading of a print mark on said strip material.

4. The method defined in claim 1 wherein said length is folded by entrainment of said length by said plate into said positioning tongs, further comprising the step of heat sealing wings of the folded length of each other after severing of said length from said supply.

5. A label-making apparatus comprising:

a dispenser containing a supply of strip material;

a feeding device above said dispenser for entraining a length of said strip material upwardly, said feeding device including:

lateral walls defining a guide channel and adjustable to various widths of the strip material, and a pair of pressure roller displaceable relative to one another and movable with said lateral walls, said pressure rollers being brought toward one another to prevent free withdrawing of said strip of material from said dispenser;

a gripper disposed above said feeding device for receiving an upper end of said length of said strip material;

a folding plate displaceable along a path transverse to the length of said strip material between said supply and said gripper;

a positioning tongs having a pair of jaws open toward said plate and in a path of said plate whereby displacement of said plate in one direction along said path deflects said length of said strip material in said direction along said path and along said plate between said jaws of said positioning tongs;

means below said path for severing said length from said supply, said pressure rollers engaging said lateral walls of said feeding device upon severing said length; and means for braking advance of said plate in said one direction for slowing down said plate, said means for braking including a throttle for a cylinder displacing said plate.

6. The apparatus defined in claim 5 wherein said pair of pressure rollers is displaceable toward, said pair of rollers being displaceable downwardly away from said gripper upon receiving said upper end of the strip in said gripper.

7. The apparatus defined in claim 5, further comprising a print-mark reader with a reading head responsive to a print mark on said strip material for controlling said means for braking.

8. The apparatus defined in claim 5 wherein said feeding plate folds said length to cause wings of said length to lie one on another, said apparatus further comprising a heat-sealing device for heat-sealing said wings together.

* * * * *